US005674665A

United States Patent [19]

Sawyer et al.

[11] Patent Number: 5,674,665

[45] Date of Patent: Oct. 7, 1997

[54] LOW CONTRAST FILM

[75] Inventors: John Frank Sawyer; Michael Paul Keyes, both of Fairport; John Charles Brewer, Rochester; John Tyler Keech, Penfield; Elizabeth Laura Kelly, Webster, all of N.Y.

[73] Assignee: Eastman Kodak Company, Rochester, N.Y.

[21] Appl. No.: 560,134

[22] Filed: Nov. 17, 1995

Related U.S. Application Data

[63] Continuation of Ser. No. 270,063, Jul. 1, 1994, abandoned, which is a continuation-in-part of Ser. No. 246,598, May 20, 1994, abandoned.

[51] Int. Cl.[6] ..... G03C 7/22; G03C 7/407

[52] U.S. Cl. ..... 430/383; 430/359; 430/503; 430/504; 430/505; 430/506

[58] Field of Search ..... 430/503, 504, 430/506, 359, 383, 505

[56] References Cited

U.S. PATENT DOCUMENTS

| | | | |
|---|---|---|---|
| 3,849,138 | 11/1974 | Wyckoff | 96/74 |
| 4,680,253 | 7/1987 | Shibahara et al. | 430/504 |
| 4,792,518 | 12/1988 | Kuwashima et al. | 430/505 |
| 5,266,451 | 11/1993 | Schmuck et al. | 430/506 |
| 5,300,381 | 4/1994 | Buhr et al. | 430/30 |
| 5,314,793 | 5/1994 | Chang et al. | 430/506 |
| 5,360,703 | 11/1994 | Chang et al. | 430/506 |

FOREIGN PATENT DOCUMENTS 324471 7/1989 European Pat. Off. .

OTHER PUBLICATIONS

*The Negative* by Ansel Adams, New York Graphic Society, Boston, MA USA (1981), Chapter 4, "The Zone System", pp. 47–98.

*SMPTE Journal, vol. 91, No. 10, Oct. 1982, Scarsdale New York, pp. 922–930 "Eastman Color High–Speed Negative Film 5293", by Glenn L. Kennel, Richard C. Sehlin, F. R. Reinking, S. W. Spakowsky, and G. L. Whittier.

*Primary Examiner*—Richard L. Schilling

*Attorney, Agent, or Firm*—Andrew J. Anderson

[57] ABSTRACT

A color negative photographic film wherein on the curve of density versus log E for each color sensitive record: (1) a straight line, which connects the point at density Dmin+0.1 and the point at 1.5log E above the exposure required for density Dmin+0.2, has a mathematical slope ≦ 0.50; and (2) the difference in log E is ≧1.7 between the point 0.9log E above the exposure required for density Dmin+0.2 and the point where the density difference is 0.1 between the curve and the straight line which results from a linear regression of the three density points at exposures 0.3log E, 0.9log E, and 1.5log E above the exposure required for the density Dmin+0.2; and (3) the difference in log E is ≧1.20 between the exposure needed for density Dmin+0.1 and the point that corresponds to the exposure, in lux-seconds, of 9.2/(Film Speed). The exposure of the foregoing gray card is a typical normal exposure based on the film speed rating (i.e. the film is not overexposed or underexposed).

12 Claims, 5 Drawing Sheets

LOW CONTRAST FILM

Figure 1C:
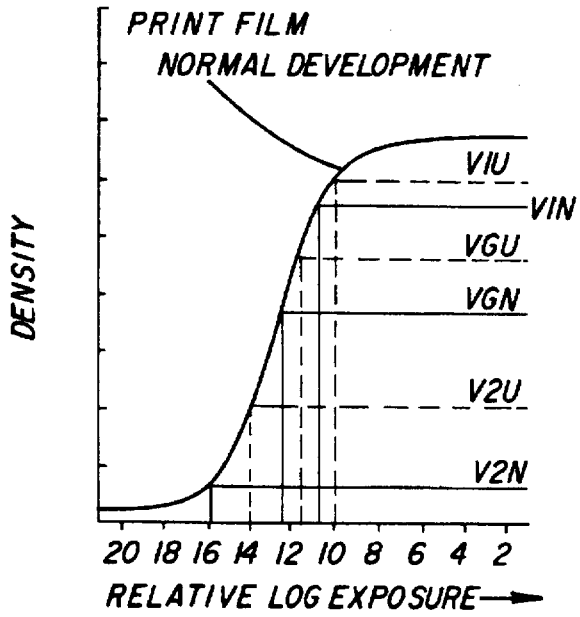

This is a continuation of U.S. Ser. No. 08/270,063, filed 1 Jul. 1994, now abandoned, which is a continuation-in-part of U.S. patent application Ser. No. 08/246,598, filed May 20, 1994, now abandoned.

FIELD OF THE INVENTION

The invention relates to a low contrast color negative film, particularly such a motion picture film, which has low contrast and yet provides good black images and good latitude without the user having to resort to experimental exposure or processing conditions which may otherwise cause useful film parameters to be exceeded during use.

BACKGROUND

Photographers and cinematographers frequently require low contrast in the images of original scenes they create for viewing. The purpose is to create a different, "softer" look to the image. At the same time, there is a widely accepted need in the field of color image reproduction, particularly in the area of motion pictures, for increasing the range of subject luminance that can be recorded and transformed into a viewed image. Most interest is with increasing the luminance range from the shadow regions of original scenes, but there is interest with increasing the luminance range in the highlight regions as well.

However, photographers and cinematographers also require blacks and whites in their scenes to be reproduced faithfully in the viewed images, and to not be altered by the photosensitive recording material. For example, areas of a scene, which are described as black, should be recorded in such a way that those same areas in the viewed image would be sufficiently dark so that they would also be characterized as black. Also, areas of a scene, which are described as white, should be recorded in such a way that those same areas in the viewed image would be sufficiently light so that they would be characterized as white.

One method available to photographers and cinematographers for extending the subject luminance range, is to over-expose the color negative photosensitive material when recording the original scene. This allows more light from the original scene to strike the negative material than recommended by the manufacturer of the negative material. There is a risk, however, that the color negative photosensitive material may not be capable of recording the full range of luminance with the over-exposure. More importantly, it is possible that the contrast of current photographic materials is so high that the increased shadow information would be at too high a density in the print to be perceptible. The result is loss of whites recorded on the color negative photosensitive material and in the viewed image.

More importantly, the solution available to photographers and cinematographers for making a reproduced image with low contrast, is to lower the gamma of the color negative photosensitive material. There are two currently available methods for lowering gamma.

The first method of achieving lower overall gamma with silver halide based films is by reducing the development time outside the specifications provided by the manufacturer—a condition known as under-development or pull-processing. One way this is practiced in the art is to empirically plot gamma against development time. From the results, an appropriate development time is chosen. Gamma is calculated from a plot of density versus log E. This is described in *The Manual of Photography* by Ralph E. Jacobson, Focal Press, 1978.

The second method to lower the gamma in the color negative photosensitive materials is to alter the exposure protocol, specified by the manufacturer, with a technique called "flashing." With this technique, a film is exposed to a weak, but uniform, level of light prior to development. The exposure can be applied either before or after exposure to record the desired image. The level of light that must be used is determined by an empirical, trial-and error procedure. This is described in *American Cinematographer Manual*, 6th edition, The ASC Press, 1986 and in *Motion Picture Film Processing* by Dominic Case, Focal Press, 1985.

The present inventors recognized that neither of the two currently available strategies will maintain blacks nor, to a lesser extent, whites from the original scene to the viewed image. The present inventors also recognized the reasons why this was so, and the means to overcome this problem.

SUMMARY OF THE INVENTION

The present invention is a color negative photosensitive material with a preferential tone mapping. Film constructed according to the invention provides the ability to record original scenes and create viewed images with a large range of subject luminance and low contrast, but with blacks and whites from the original scene reproduced faithfully. An additional advantage is the improved ability to adequately record luminance levels that come from over-exposure of the color negative photosensitive material to the original scene.

Accordingly, the present invention provides an unexposed color negative photographic film comprising red, green and blue color sensitive records, wherein on the curve of density versus log E for each color sensitive record: (1) a straight line, which connects the point at density Dmin+0.1 and the point at 1.5log E above the exposure required for density Dmin+0.2, has a mathematical slope $\leqq 0.60$; and (2) the difference in log E is $\leqq 1.5$ between the point 0.9log E above the exposure required for density Dmin+0.2 and the point where the density difference is 0.1 between the curve and the straight line which results from a linear regression of the three density points at exposures 0.3log E, 0.9log E, and 1.5log E above the exposure required for the density Dmin+0.2; and (3) the difference in log E is $\leqq 1.20$ between the exposure needed for density Dmin+0.1 and the exposure, in lux-seconds, of 9.2/(Film Speed).

The present invention further provides a method of exposing the foregoing film of the present invention, which method comprises imagewise exposing the film with a normal exposure according to the speed value indicated with the film or its packaging.

DRAWINGS

FIG. 1 shows a Jones diagram of a typical color negative photosensitive material with normal development (solid line) and under-development (dotted line). FIG. 1*a* shows the negative curves of density versus log E. FIG. 1*b* shows a characteristic transfer function of the printer. FIG. 1*c* shows a characteristic curve for print film. FIG. 1*d* shows the curves of viewed density versus log E.

Figure 1D:
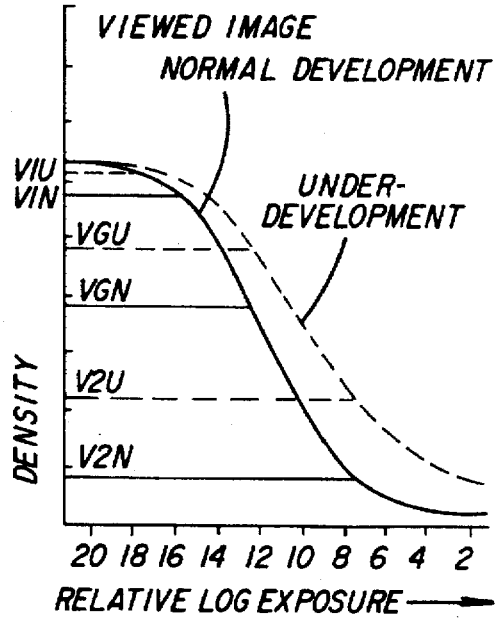
Figure 1B:
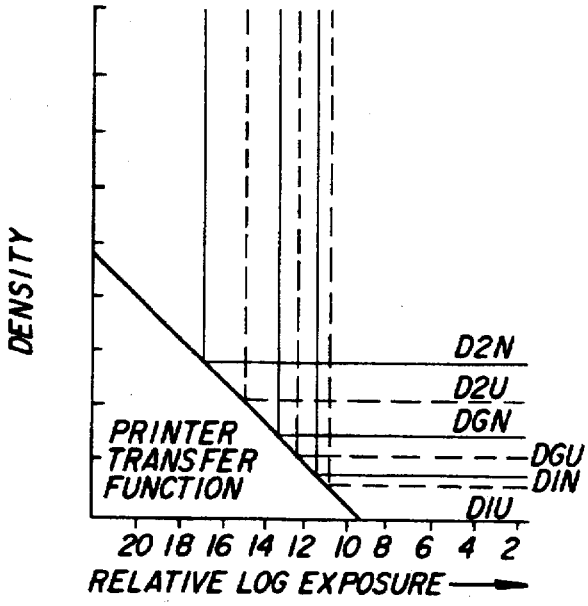
Figure 2B:
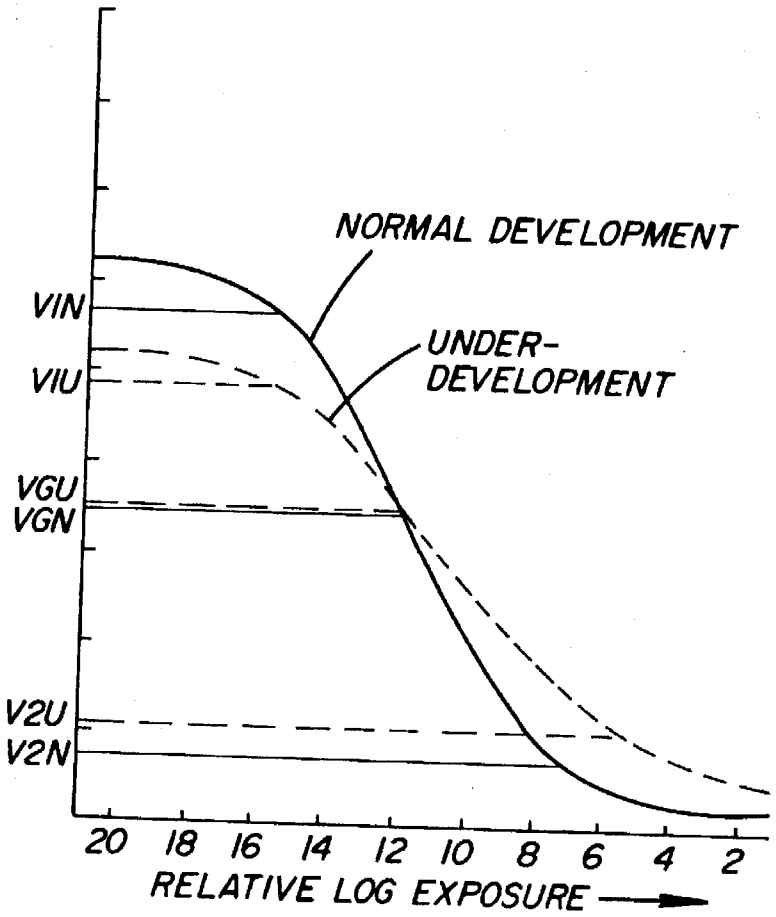
Figure 2A:
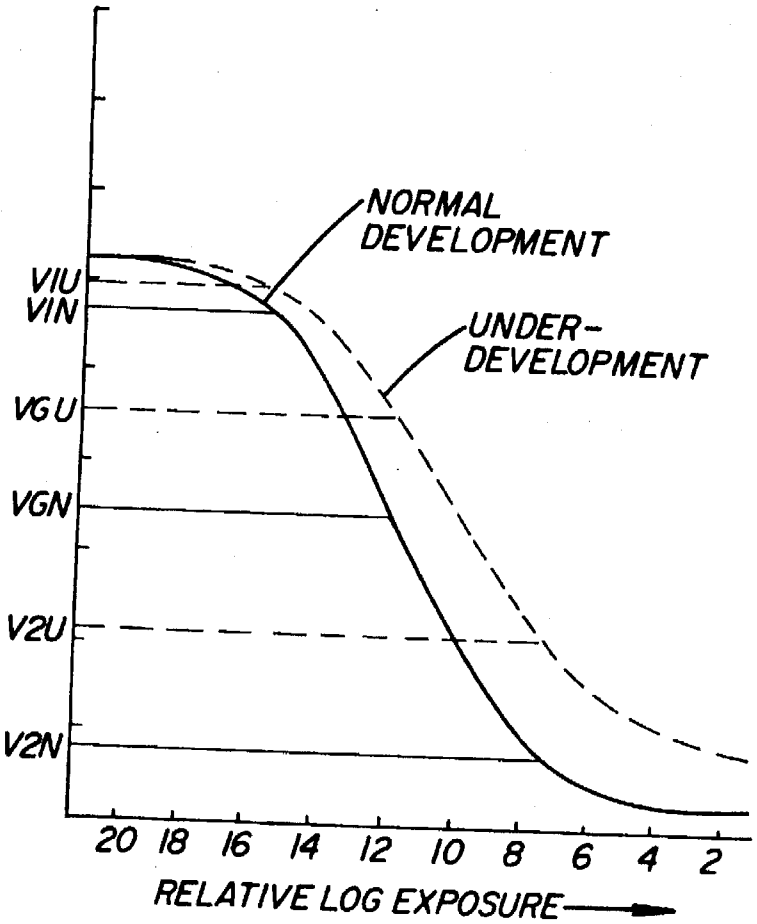

FIG. 2 shows the effects of matching the viewed densities resulting from an 18% gray card exposure on the color negative photosensitive material with normal development and under-development. FIG. 2*a* reproduces FIG. 1*d*. FIG. 2*b* shows the same curves after adjusting the under-developed curve such that the viewed densities for the 18% gray card matches.

Figure 3C:
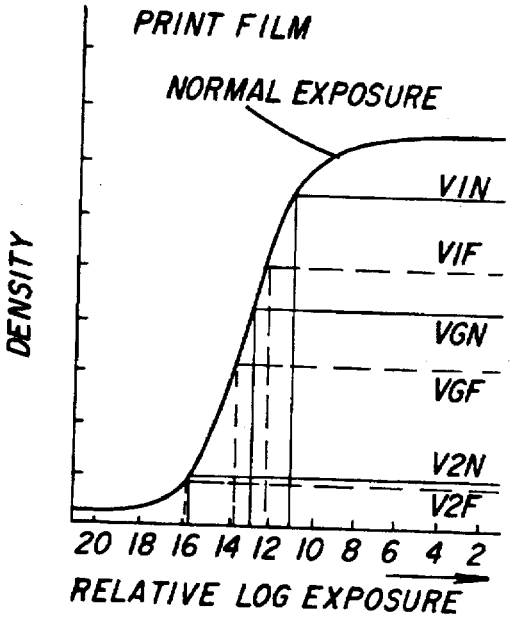
Figure 3D:
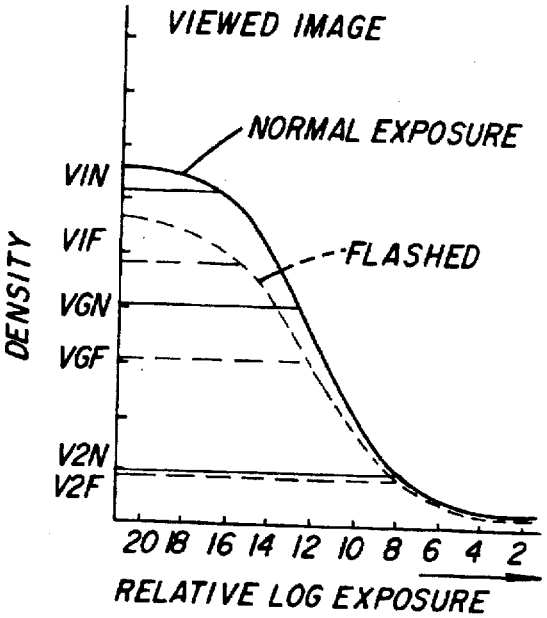
Figure 3B:
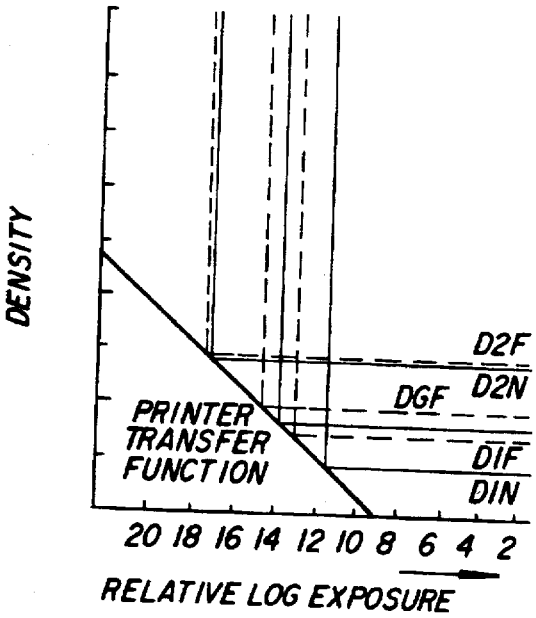
Figure 3A:
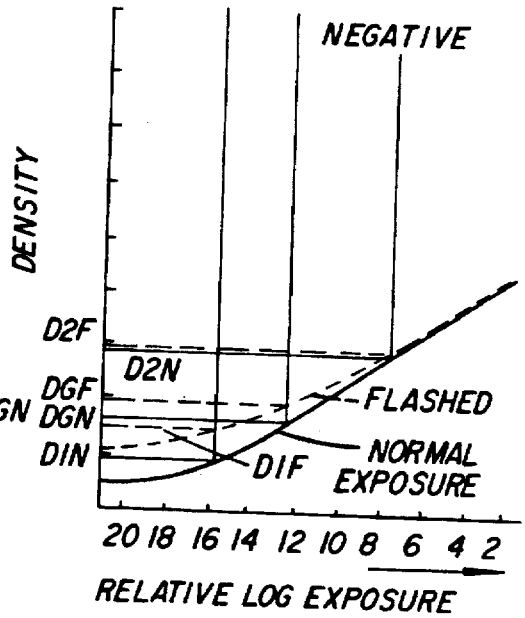

FIG. 3 shows a Jones diagram of a typical color negative photosensitive material with normal exposure (solid line)

and flashing (dotted line). FIG. 3*a* shows the negative curves of density versus log E. FIG. 3*b* shows a characteristic transfer function of the printer. FIG. 3*c* shows a characteristic curve for print film. FIG. 3*d* shows the curves of viewed density versus log E.

Figure 4B:
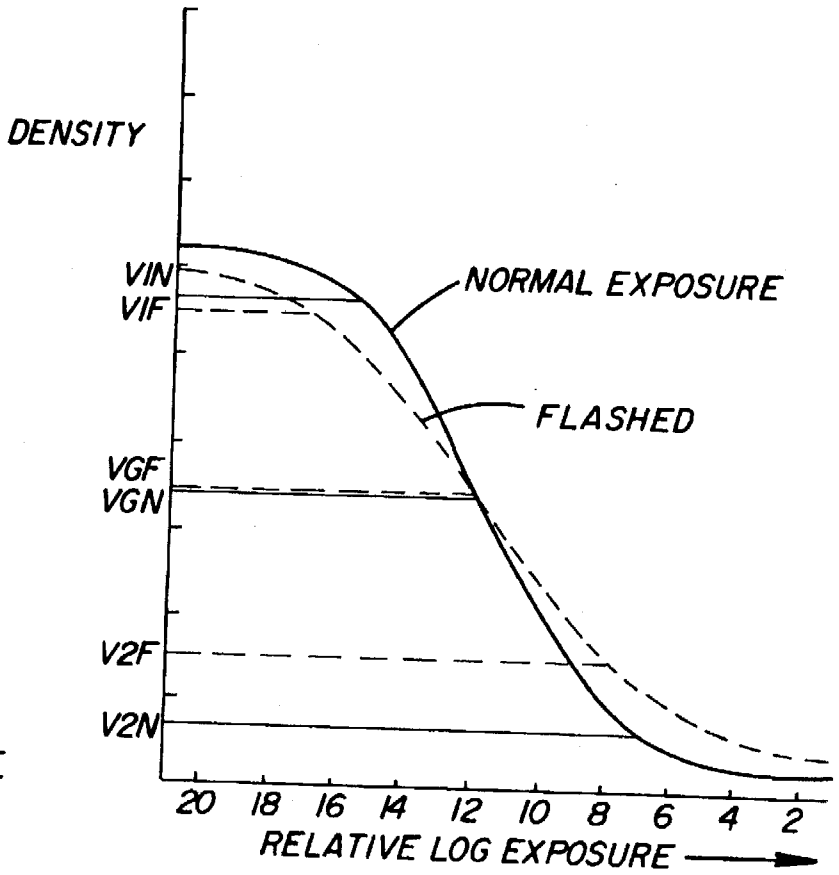
Figure 4A:
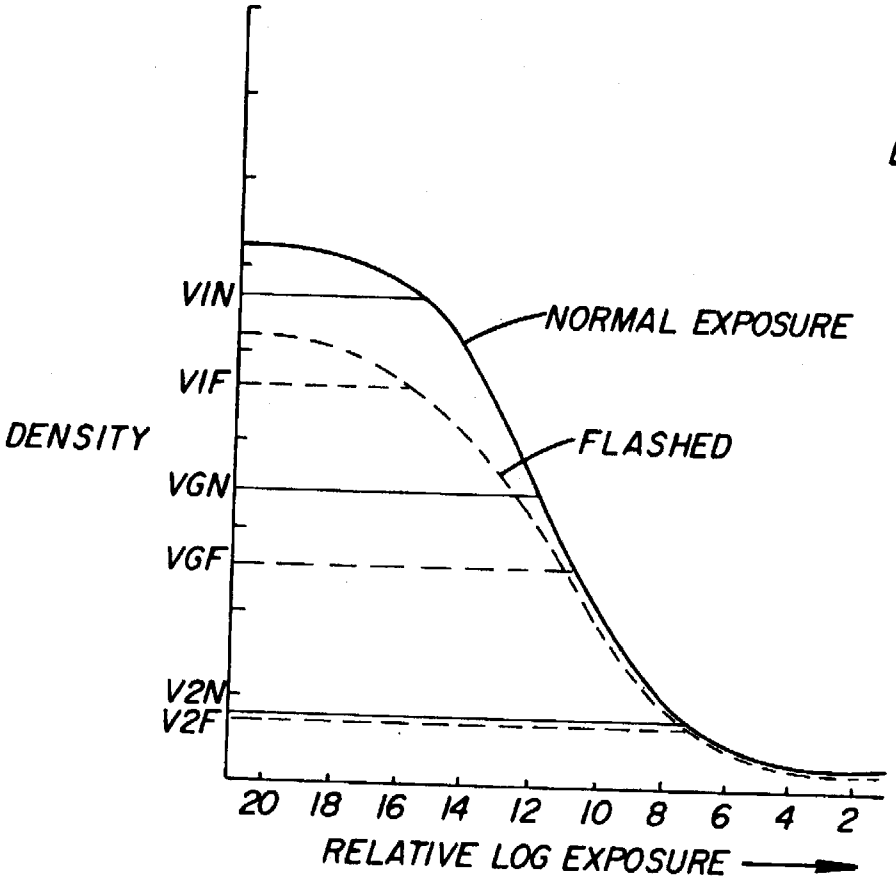

FIG. 4 shows the effects of matching the viewed densities resulting from an 18% gray card exposure on the color negative photosensitive material with normal development and flashing. FIG. 4*a* reproduces FIG. 3*d*. FIG. 4*b* shows the same curves after adjusting the flashed curve such that the viewed densities for the 18% gray card matches.

Figure 5:
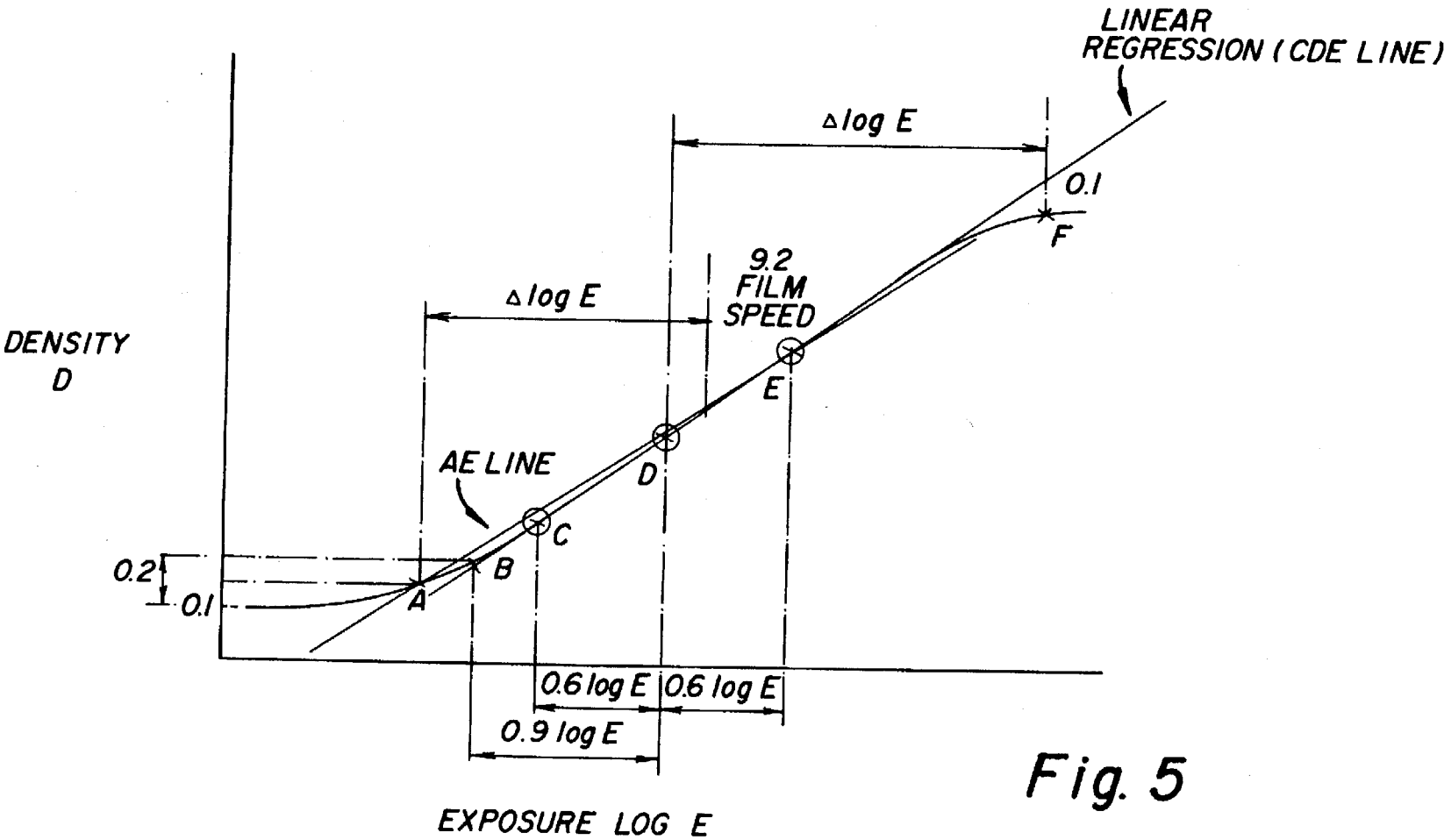

FIG. 5 shows the characteristic curve for the invention. Points A and B occur on the curve where the densities are 0.1 and 0.2 above Dmin, respectively. Point D occurs on the curve where the exposure is 0.9log E above point B. Points C and E occur on the curve where the exposures are 0.6log E less than and greater than the exposure at point D, respectively. The "AE" line connects the points A and E. The "CDE" line is calculated from a linear regression using the method of least squares with points C, D, and E. Point F occurs on the curve at that exposure that results in a density difference of 0.1 between the CDE line and the curve.

EMBODIMENTS OF THE INVENTION

To appreciate the effects of the present invention, it is first useful to understand the effects of the prior art techniques of under-development or flashing which are used to obtain a lower contrast (that is, lower gamma value), and their resulting disadvantages for a color negative film. Although only one color record will be considered, a corresponding analysis applies to all three color records of a typical three color record film.

First, from FIGS. 1 and 2, one can fully understand the effects of under-development. The plot in FIG. 1 is commonly known as a Jones diagram, a general description of which is provided in *The Theory of the Photographic Process*, T. H. James, ed., Macmillan Publishing Co., Inc., 1977, Chapter 19. FIG. 1*a* depicts typical curves of density versus log E for negative photosensitive material with normal development and under-development. FIG. 1*b* depicts the characteristic transfer function of the printer with slope equal to 1, assuming a completely diffuse light source and no flare or stray light is present. FIG. 1*c* depicts the characteristic curve for the print film on which the viewed image is created. FIG. 1*d* depicts the curves corresponding to the viewed images derived from the negative photosensitive material with normal development and under-development.

Figure 1A:
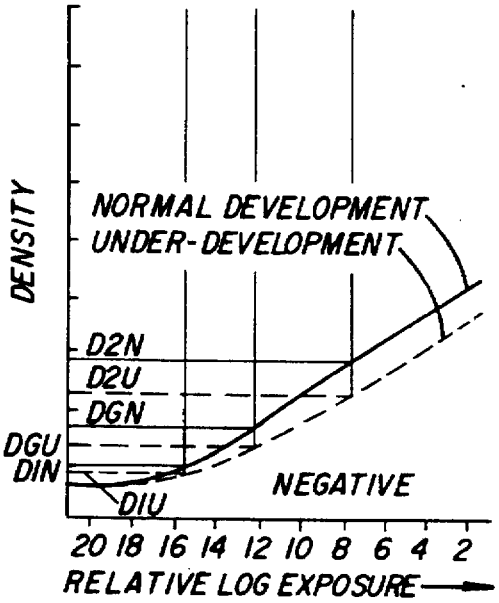

In FIG. 1*a*, points E1, E2, and Eg define the luminance from the darkest, brightest and 18% gray card from the original scene, respectively (it will be understood throughout this application that when an 18% gray card exposure is referenced then, unless the contrary is indicated, this means a "normal" exposure of the film to an 18% gray card; that is a normal exposure which would be given to the 18% gray card based on the film speed indicated on the film or its packaging). They result in two sets of density points in the negative material: D1N, D2N, and DgN depict the densities from E1, E2, and Eg with normal development, and D1U, D2U, and DgU depict the densities from E1, E2, and Eg with under-development. When the viewed image is created using a photosensitive material with characteristic curves depicted in FIG. 1*d*, points D1N, D2N, and DgN transform into viewed density points, V1N, V2N, and VgN, and points D1U, D2U, and DgU transform into viewed density points V1U, V2U, and VgU.

It is common in the art to match the viewed densities in the reproduced images from different films, which result from a standard subject, such as an 18% gray card, in the original scene. FIG. 2*a* reproduces the curves in FIG. 1*d*, and FIG. 2*b* shows the effects when the viewed densities for the 18% gray card from the original scene are matched for both reproduced images. The common method for matching the densities resulting from the gray card is to adjust the printer exposure for one of the negatives when creating the viewed images on print film. In this case, the printer exposure would be decreased for the under-developed negative as compared to the normally developed negative.

There are two conclusions for FIG. 2. First, under-development results in lower contrast in the viewed image. The difference between V1U and V2U must be less than the difference between V1N and V2N. This results in a smaller density range in the viewed image for the subject luminance range from E1 to E2. For a given scene, the effect will be lower contrast to the viewer than if normal development of the negative material had been used. Second, under-development can not maintain the darkness of blacks in the viewed image. The maximum density resulting from the under-developed negative (V1U) must be lower than the maximum density from the normally developed negative (V1N). For a given scene, black regions in the original scene will be perceived as less dark to the viewer than if normal development of the negative material had been used. The inability of under-development to maintain blacks is a critical shortcoming in the prior art.

The second strategy to lower the gamma in the color negative photosensitive materials is to alter the exposure protocol, specified by the manufacturer, with a technique called "flashing." With this technique, a film is exposed to a weak, but uniform, level of light prior to development. The uniform exposure can be applied either before or after exposure to record the desired image (that is, imagewise exposure). The level of light that must be used is determined by an empirical, trial-and error procedure. This is described in *American Cinematographer Manual*, 6th edition, The ASC Press, 1986 and in *Motion Picture Film Processing* by Dominic Case, Focal Press, 1985.

From FIGS. 3 and 4, one can fully understand the effects of flashing. Again, the Jones diagram is used in FIG. 3. FIG. 3*a* depicts typical curves of density versus log E for negative photosensitive material with normal exposure and flashing. FIG. 3*b* depicts the characteristic transfer function of the printer with slope equal to 1, assuming a completely diffuse light source and no flare or stray light is present. FIG. 3*c* depicts the characteristic curve for the print film on which the viewed image is created. FIG. 3*d* depicts the curves corresponding to the viewed images derived from the negative photosensitive material with normal exposure and flashing.

In FIG. 3*a*, points E1, E2, and Eg define the luminance from the darkest, brightest and 18% gray card from the original scene, respectively. They result in two sets of density points in the negative material: D1N, D2N, and DgN depict the densities from E1, E2, and Eg with normal exposure, and D1F, D2F, and DgF depict the densities from E1, E2, and Eg with flashing. When the viewed image is created using a photosensitive material with characteristic curves depicted in FIG. 3*d*, points D1N, D2N, and DgN transform into viewed density points, V1N, V2N, and VgN, and points D1F, D2F, and DgF transform into viewed density points V1F, V2F, and VgF.

FIG. 4*a* reproduces the curves in FIG. 3*d*, and FIG. 4*b* shows the effects when the viewed densities for the 18% gray card from the original scene are matched for both reproduced images. In this case, the printer exposure would be increased for the flashed negative as compared to the normally exposed negative.

There are two conclusions from FIG. 4. First, flashing results in lower contrast in the viewed image. The difference between V1F and V2F must be less than the difference between V1N and V2N. This results in a smaller density range in the viewed image for the subject luminance range from E1 to E2. For a given scene, the effect will be lower contrast to the viewer than if normal exposure of the negative material had been used. Second, flashing can not maintain the darkness of blacks in the viewed image. The maximum density resulting from the flashed negative (V1F) must be lower than the maximum density from the normally exposed negative (V1N). For a given scene, black regions in the original scene will be perceived as less dark to the viewer than if normal exposure of the negative material had been used. The inability of flashing to maintain blacks is a critical shortcoming in the current art.

Blacks can be maintained with under-development and flashing by over-exposing the negative photosensitive material. Over-exposure is characterized by adjustments made to the exposure conditions which allow more light to strike the color negative photosensitive material than that specified by the manufacturer. A combination of under-development and over-exposure conditions to maintain blacks relative to the normal development and exposure conditions can only be obtained with a difficult, empirical procedure. Similarly, a combination of flashing and over-exposure conditions to maintain the blacks relative to the normal exposure condition can only be obtained with a difficult, empirical procedure. There is a risk, however, that the color negative photosensitive material may not be capable of recording the full range of luminance, E1 to E2, with over-exposure. The result is loss of highlight detail recorded on the color negative photosensitive material and in the viewed image.

The present invention provides a preferred tone mapping for color negative photosensitive materials that provides the desired luminance range and the desired contrast while faithfully maintaining blacks and whites when creating the viewed image. The invention provides a color negative photosensitive material that, when exposed through a step wedge and read for status M densitometry, the resulting curves of density versus log E for all the color records has a novel combination of features, which are responsible for the advantages offered by the invention. It will be appreciated from FIGS. 1 through 5 that a film meeting the required parameters will provide a low contrast, while particularly maintaining reproduction of blacks and at the same time permitting a large range of subject (that is, image) luminance.

To help describe the invention, points and lines are defined on a density versus log E curve in FIG. 5. Points A and B occur on the curve where the densities are 0.1 and 0.2 above Dmin, respectively. Point D occurs on the curve where the exposure is 0.9log E above point B. Points C and E occur on the curve where the exposures are 0.6log E less than and greater than the exposure at point D, respectively. To further describe the invention, two lines are defined. One connects the points A and E, called the "AE line." The other, called the "CDE line," is calculated from a linear regression using the method of least squares with points C, D, and E. Point F occurs on the curve at that exposure that results in a density difference of 0.1 between the CDE line and the curve.

The three criteria of this invention have been identified above and are now described further.

1) First, the slope of the AE line is used to define the average gamma in the mid-scale and the toe regions, and ultimately, the contrast and the subject luminance range in the shadow regions when the viewed image of the original scene is created. Within the scope of the invention, the slope of this line is less than or equal to 0.60 (or even 0.55, 0.50, 0.45 or 0.40) for all of the color records in the photosensitive material.

2) Second, the points D and F are used to define the curve shape in the upper scale, and ultimately the subject luminance range in the highlight regions when the viewed image of the original scene is created. The difference in exposure between points D and F must be large enough to allow the photosensitive material to record a sufficient range of scene luminance in the highlight regions. This is necessary for a sufficient range of densities to be recorded on the photosensitive material, and for accurate and precise reproduction of the scene when viewed images are created. The exposure difference must also be large enough to ensure proper reproduction of the black and white areas of the scene when viewed images are created. Within the scope of the invention, the log E difference must be greater than or equal to 1.5 (or more preferably, 1.6 or 1.7, or even 1.8 or 1.9) for all the color records in the photosensitive material.

3) Third, the difference in log E between point A and exposure, in lux-seconds, of 9.2/(Film Speed) relates to the density recorded for the blacks in the original scene and the density range that is able to record shadow details from the original scene. This value may preferably be 1.3 or 1.4 (or optionally even 1.5). The exposure, in lux-seconds, of 9.2 divided by the Film Speed, is the numerical equivalent to the exposure received by a film when exposed in a normal manner (that is, correctly exposed without under or overexposure based on the film speed indicated on the film or its packaging) to an 18% gray card.

More particularly, the exposure resulting from an 18% gray card is related to the speed rating of a film. The speed rating is also referenced herein as simply "Film Speed" or "film speed" and may, for example, be a standard rating such as ASA, ISO or EI (Exposure Index) film speeds. The Film Speed is assigned to films by manufacturers to standardize exposure levels and is typically indicated on the film or its packaging. When reference is made throughout this application to Film Speed, it will be understood that such is the film speed indicated on the film or its packaging unless the contrary is indicated. Any particular speed rating is easily related to standard camera settings, such as shutter speeds and aperture settings. For example, for EI film speeds this can be found in manuals such as the Cinematographer's Field Guide, Kodak publication no. H-2, available from Eastman Kodak Company, Rochester, N.Y. (U.S. Library of Congress Catalog Card No. 91-77431; ISBN 0-87985-748-X).

A combination of shutter speed and aperture settings, that correspond to a normal exposure of 200 speed film, corresponds to an exposure of 0.046 lux-seconds to the film for an 18% gray card. For a factor, x, change in the EI speed rating, the exposure of an 18% gray card changes by 1/x. For instance, for a 400 speed film, x=2, and the 18% gray card exposure is (0.046/2)=0.023 lux-seconds. Or for any film, the normal exposure of an 18% gray card corresponds to an exposure, in lux-seconds, of 9.2/(Film Speed).

In the art (particularly in the art of motion picture film), when positive images are created for viewing from negative photosensitive materials, the density for the gray card in the viewed image will be adjusted to a certain density on the viewed image. This is to ensure that the range of densities recorded for the original scene on the negative photosensitive material can be properly recorded on the photosensitive material with the viewed image. If the negative photosensitive material is slow, the gray card density will have a low density on the negative image and a high density on the viewed image. The exposure to create the viewed image will be adjusted to lower the gray card density in the viewed image to the appropriate value. This lowers all the densities in the viewed image, including that for the blacks of the original scene. Consequently, lighter blacks are recorded on the viewed image, and the blacks are no longer perceived as pure black. To prevent the loss of blacks in the viewed image, the difference in log E between point A and the density point from the normally exposed 18% gray card (that is, density point from exposure in lux-seconds, of 9.2/Film Speed) must be greater than or equal to 1.20 (or even 1.3 or 1.4) for all color records in the negative curve shape of the invention.

It will be appreciated, of course, that for any film it is normally desirable that the characteristic curves (that is, the D log E curves) for all color records are matched (that is, are substantially the same). This ensures that objects having neutral tone in the original scene are recorded with neutral tone on the film regardless of exposure level.

In constucting films according to the invention, the required three parameters can be achieved by various techniques, examples of which are described below. These techniques are applied to each color record of a silver halide photographic element so that all color records will meet the requirements of the present invention:

1) For example, to adjust the first parameter (the slope of the AE line) and to thereby adjust contrast in viewed images, one can typically adjust the amounts of photosensitive silver halide emulsion, image coupler, or DIR compounds that are coated in the film. In a typical color negative film, the slope of the AE line can be lowered by decreasing the amount of silver halide emulsion, decreasing the amount of image coupler, or increasing the amount of DIR compounds. Also, using an image coupler with lower dye density yield will lower the slope of the AE line.
2) To adjust the second parameter which ultimately defines the subject luminance range, ways to increase the scene luminance range which is capable of being recorded include, but are not limited to: increasing the ratio of a slow silver halide emulsion to a faster one in a layer containing at least two emulsions, adding an extra silver halide emulsion which is slower than the others in a layer containing at least one emulsion, or increasing the ratio of a less active image dye forming coupler to a more active one when two or more image dye forming couplers are present. The latter technique effectively increases the dye latitude in a developed color negative film for a given amount of developed silver.
3) To adjust the third parameter, the difference in log E between the exposure needed for density Dmin+0.1 and the point that corresponds to the exposure, in lux-seconds, of 9.2/(Film Speed) (again, this corresponds to a normal 18% gray card exposure), any technique which will vary film speed can be used. Increasing film speed results in a lowering of this logE parameter. Such techniques include the use of silver halide emulsions of different sensitivity, such being attainable with silver halide emulsions of higher intrinsic speed (for example, emulsions of larger grain), silver halide emulsions sensitized with different sensitizing dyes, and other means known in the art.

As described above, the elements of the present invention may be imagewise exposed with a normal exposure according to the speed value indicated with the film or its packaging, and processed according to the processing conditions indicated on the film or its packaging. This is advantageous in that the film user need not experiment with various under-development conditions or flashing conditions. The film of the present invention is simply exposed and processed according to the manufacturer's indications without flashing, and the advantages of the film (lower contrast with good reproduction of blacks, with good luminance range) are obtained.

By "indicated" in relation to the film speed and processing conditions, means that some designation is provided on the film or its packaging or associated with one or the other, which allows the user to ascertain the manufacturer's speed rating (or film processing conditions). Such a designation can be a film speed number (such as Film Speed, or ASA Film Speed), or in the case of processing conditions, an actual statement of the conditions or reference to a well-known standard processing method (for example, Kodak ECN-2 processing). Alternatively, such a designation can be a film identification designation (such as a number or film name) which allows a user to match the film with the manufacturer's speed designation or processing conditions (such as from a catalogue, brochure or other source).

As already described, the photographic elements of the present invention are color elements and contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In a alternative, less preferred, format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler, at least one of the couplers in the element being a coupler. The element can contain additional layers, such as filter layers, interlayers, overcoat layers, subbing layers, and the like.

In the following discussion of suitable materials for use in elements of this invention, reference will be made to *Research Disclosure*, December 1989, Item 308119, published by Kenneth Mason Publications, Ltd., Dudley Annex, 12a North Street, Emsworth, Hampshire P010 7DQ, ENGLAND, which will be identified hereafter by the term "Research Disclosure I." The Sections hereafter referred to are Sections of the Research Disclosure I.

The silver halide emulsions employed in the elements of this invention will be negative-working emulsions. Suitable emulsions and their preparation as well as methods of chemical and spectral sensitization are described in Sections I through IV. Color materials and development modifiers are described in Sections V and XXI. Vehicles which can be used in the elements of the present invention are described in Section IX, and various additives such as brighteners, antifoggants, stabilizers, light absorbing and scattering materials, hardeners, coating aids, plasticizers, lubricants and matting agents are described, for example, in Sections V, VI, VIII, X, XI, XII, and XVI. Manufacturing methods are described in Sections XIV and XV, other layers and supports in Sections XIII and XVII, and exposure alternatives in Section XVIII.

The photographic elements of the present invention may also use colored couplers (e.g. to adjust levels of interlayer correction) and masking couplers such as those described in EP 213.490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps, for example, of bleaching or fixing to improve the quality of the image. Bleach accelerators described in EP 193,389; EP 301,477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the couplers may be blocked or coated in protected form as described, for example, in Japanese Application 61/258,249 or U.S. Pat. No. 5,019,492.

The photographic elements may further contain image-modifying compounds such as "Developer Inhibitor-Releasing" compounds (DIR's). Useful DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. Nos. 4,346,165; 4,540,653 and 4,906,559); with ballasted chelating agents such as those in U.S. Pat. No. 4,994,359 to reduce sensitivity to polyvalent cations such as calcium; and with stain reducing compounds such as described in U.S. Pat. Nos. 5,068,171 and 5,096,805. Other compounds useful in the elements of the invention are disclosed in Japanese Published Applications 83-09,959; 83-62,586; 90-072,629, 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements of the present invention may be silver bromoiodide, silver bromide, silver chloride, silver chlorobromide, silver chlorobromo-iodide, and the like. The type of silver halide grains preferably include polymorphic, cubic, and octahedral. The grain size of the silver halide may have any distribution known to be useful in photographic compositions, and may be ether polydipersed or monodispersed. Particularly useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in microns and t is the average thickness in microns of the tabular grains.

The average useful ECD of photographic emulsions can range up to about 10 microns, although in practice emulsion ECD's seldom exceed about 4 microns. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micron) tabular grains. To achieve the lowest levels of granularity it is preferred to that aim tabular grain projected areas be satisfied with ultrathin ($t<0.06$ micron) tabular grains. Tabular grain thicknesses typically range down to about 0.02 micron. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micron.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions tabular grains satisfying the stated thickness criteria above account for at least 70 percent of the total grain projected area. In the highest performance tabular grain emulsions tabular grains satisfying the thickness criteria above account for at least 90 percent of total grain projected area.

Suitable tabular grain emulsions can be selected from among a variety of conventional teachings, such as those of the following: *Research Disclosure,* Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The silver halide grains to be used in the invention may be prepared according to methods known in the art, such as those described in *Research Disclosure I* and James, *The Theory of the Photographic Process.* These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with compounds such as gold sensitizers (e.g., aurous sulfide) and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as illustrated in *Research Disclosure*, June 1975, item 13452 and U.S. Pat. No. 3,772,031.

The silver halide may be sensitized by sensitizing dyes by any method known in the art, such as described in *Research Disclosure I.* The dye may be added to an emulsion of the silver halide grains and a hydrophilic colloid at any time prior to (e.g., during or after chemical sensitization) or simultaneous with the coating of the emulsion on a photographic element. The dye/silver halide emulsion may be mixed with a dispersion of color image-forming coupler immediately before coating or in advance of coating (for example, 2 hours).

Photographic elements of the present invention may also usefully include a magnetic recording material as described in *Research Disclosure*, Item 34390, November 1992.

Photographic elements of the present invention are preferably motion picture film elements. Such elements typically have a width of up to 100 millimeters (or only up to 70 or 50 millimeters), and a length of at least 30 meters (or optionally at least 100 or 200 meters). The manufactured elements are provided to a user with a speed value of the film indicated on the film or its packaging.

Photographic elements of the present invention are preferably imagewise exposed using any of the known techniques, including those described in *Research Disclosure I*, section XVIII. This typically involves imagewise exposure to light in the visible region of the spectrum. Elements of the present invention are particularly useful for exposing under fluorescent lighting.

Photographic elements comprising the composition of the invention can be processed in any of a number of well-known photographic processes which form negative dye images, utilizing any suitable processing composition, described, for example, in *Research Disclosure I*, or in James, *The Theory of the Photographic Process* 4th, 1977. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying.

Following the processing step, a negative of the present invention is then used to produce a print as already described above.

The following examples illustrate preparation of elements of the present invention, and their beneficial characteristics.

EXAMPLE

The following layers were coated on a transparent base to make a film of the present invention:

| | mg/sq meter |
|---|---|
| Layer 1 | |
| Slow Slow Cyan Emulsion | 489.8 |
| Slow Cyan Emulsion | 123.8 |
| Mid Cyan Emulsion | 839.6 |
| COUP-1 | 305.7 |
| COUP-2 | 21.5 |
| COUP-3 | 32.3 |
| COUP-4 | 31.2 |
| 4,5-dihydroxy-m-benzenedisulfonic acid (disodium salt) | 35.2 |

-continued

| | mg/sq meter |
|---|---|
| sodium hexametaphosphate | 20.1 |
| COUP-5 | 22.6 |
| 5-methyl-s-triazolo(2,3-A) pyrimidin-7-ol (sodium salt) | 31.5 |
| Gold (I) Sulfide | 3.6 |
| 2,5-dihydroxyl-4-(1-methylheptadecyl)-benzenesulfonic acid | 18.8 |
| Potassium Nitrate | 97.6 |
| Gelatin | 2508 |
| Layer 2 | |
| Fast Cyan Emulsion | 1022.6 |
| COUP-1 | 29.1 |
| COUP-3 | 32.3 |
| 4,5-dihydroxy-m-benzenedisulfonic acid (disodium salt) | 49.7 |
| COUP-5 | 18.3 |
| 5-methyl-s-triazolo(2,3-A) pyrimidin-7-ol (sodium salt) | 18.8 |
| Gold (I) Sulfide | 1.5 |
| 2,5-dihydroxyl-4-(1-methylheptadecyl)-benzenesulfonic acid | 6.7 |
| Gelatin | 1184 |
| Layer 3 | |
| COUP-6 | 25.8 |
| COUP-7 | 5.4 |
| Didodecylhydroquinone | 107.6 |
| N-(4-chloro-2,3-dihydro-5-hydroxy-6-benzofuranyl) butanamide | 12.9 |
| Gelatin | 646 |
| Layer 4 | |
| Slow Magenta Emulsion | 1517.7 |
| Mid Magenta Emulsion | 925.7 |
| COUP-8 | 456.4 |
| COUP-1 | 21.5 |
| COUP-9 | 134.5 |
| COUP-10 | 26.4 |
| 4,5-dihydroxy-m-benzenedisulfonic acid (disodium salt) | 39.5 |
| 2,5-dihydroxyl-4-(1-methylheptadecyl)-benzenesulfonic acid | 12.3 |
| 5-methyl-s-triazolo(2,3-A) pyrimidin-7-ol (sodium salt) | 38.0 |
| Gold (I) Sulfide | 5.5 |
| Gelatin | 2594 |
| Layer 5 | |
| Fast Magenta Emulsion | 1022.6 |
| COUP-9 | 18.3 |
| COUP-10 | 38.3 |
| COUP-8 | 21.5 |
| 4,5-dihydroxy-m-benzenedisulfonic acid (disodium salt) | 16.5 |

-continued

| | mg/sq meter |
|---|---|
| 5-methyl-s-triazolo(2,3-A) pyrimidin-7-ol (sodium salt) | 9.5 |
| Gold (I) Sulfide | 2.1 |
| N-(4-chloro-2,3-dihydro-5-hydroxy-6-benzofuranyl) butanamide | 23.9 |
| Potassium Nitrate | 98.6 |
| Gelatin | 1238 |
| Layer 6 | |
| COUP-6 | 43.1 |
| Didodecylhydroquinone | 107.6 |
| DYE-1 | 150.7 |
| Gelatin | 646 |
| Layer 7 | |
| Slow Yellow Emulsion | 176.5 |
| Mid Yellow Emulsion | 742.7 |
| COUP-11 | 62.4 |
| COUP-12 | 411.2 |
| COUP-13 | 330.5 |
| 4,5-dihydroxy-m-benzenedisulfonic acid (disodium salt) | 14.5 |
| 2,5-dihydroxyl-4-(1-methylheptadecyl)-benzenesulfonic acid | 16.1 |
| 5-methyl-s-triazolo(2,3-A) pyrimidin-7-ol (sodium salt) | 22.0 |
| Gold (I) Sulfide | 4.2 |
| 5,5-dimethyl-1,3-cyclohexanedione | 11.2 |
| 2-propargylamino benzoxazole | 0.045 |
| 2,4-dihydroxy-4-methyl-1-piperidinohexose reductone | 5.1 |
| Potassium Bromide | 3.0 |
| Potassium Nitrate | 40.0 |
| Gelatin | 1700 |
| Layer 8 | |
| Fast Yellow Emulsion | 1453.1 |
| COUP-14 | 300.3 |
| Diacetanilide | 12.9 |
| 5-methyl-s-triazolo(2,3-A) pyrimidin-7-ol (sodium salt) | 36.5 |
| Gold (I) Sulfide | 3.3 |
| N-(4-chloro-2,3-dihydro-5-hydroxy-6-benzofuranyl) butanamide | 34.4 |
| Potassium Nitrate | 76.5 |
| Gelatin | 1615 |

Surfactants were added as coating aids where appropriate as is commonly done in the art. An ultraviolet absorbing layer and a protective overcoat layer were coated over Layer 8.

The emulsions specified above and the structures of some of the compounds, are listed below:

| | |
|---|---|
| Slow Slow Cyan Emulsion | Tabular grain:<br>Iodide: 2.3%<br>Diameter = 0.64 microns<br>Thickness = 0.107 |
| Slow Cyan Emulsion | Tabular grain:<br>Iodide: 2.3%<br>Diameter = 0.98 microns<br>Thickness = 0.114 |
| Mid Cyan Emulsion | Tabular grain:<br>Iodide: 4%<br>Diameter = 1.9 microns<br>Thickness = 0.125 |
| Fast Cyan Emulsion | Tabular grain:<br>Iodide: 5%<br>Diameter = 3.5 microns<br>Thickness = 0.13 |
| Slow Magenta Emulsion | Tabular grain:<br>Iodide: 4%<br>Diameter = 0.70 microns<br>Thickness = 0.101 |
| Mid Magenta Emulsion | Tabular grain:<br>Iodide: 4%<br>Diameter = 1.80 microns<br>Thickness = 0.130 |
| Fast Magenta Emulsion | Tabular grain:<br>Iodide: 4%<br>Diameter = 4.00 microns<br>Thickness = 0.118 |
| Slow Yellow Emulsion | Tabular grain:<br>Iodide: 3%<br>Diameter = 1.65 microns<br>Thickness = 0.120 |
| Mid Yellow Emulsion | Tabular grain:<br>Iodide: 5%<br>Diameter = 2.6 microns<br>Thickness = 0.120 |
| Fast Yellow Emulsion | 3-D emulsion:<br>Iodide: 9%<br>Diameter = 2.0 microns |

COUP-1

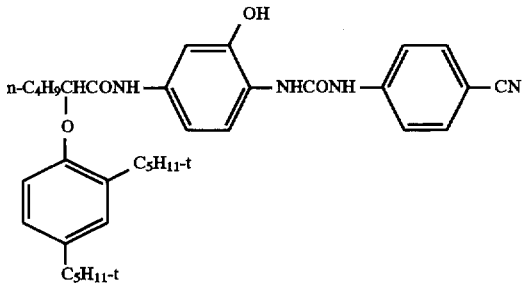

COUP-2

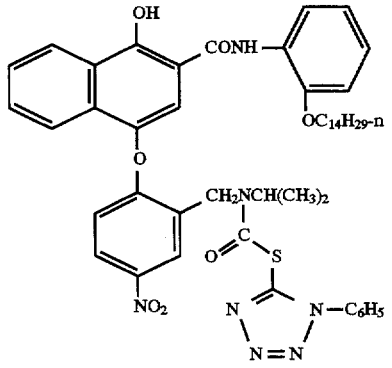

-continued
COUP-3
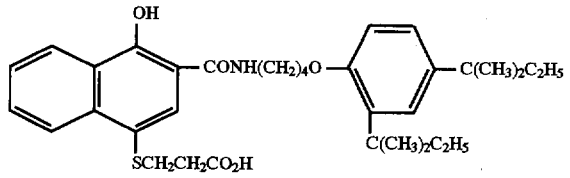
COUP-4
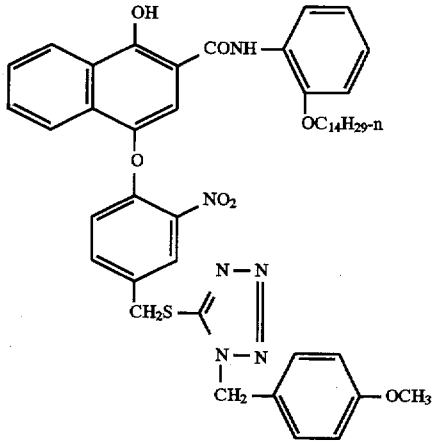
COUP-5
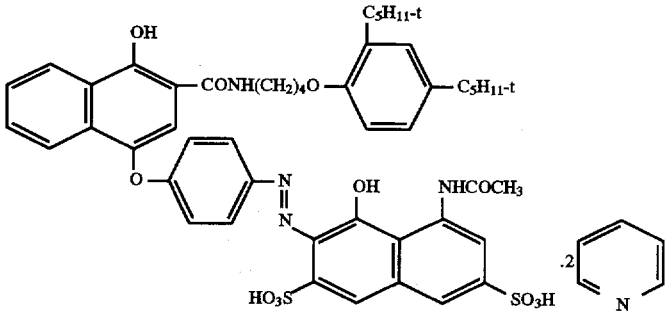
COUP-6
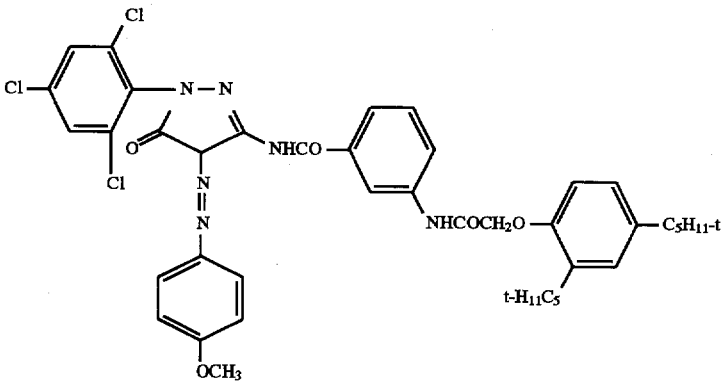
COUP-7
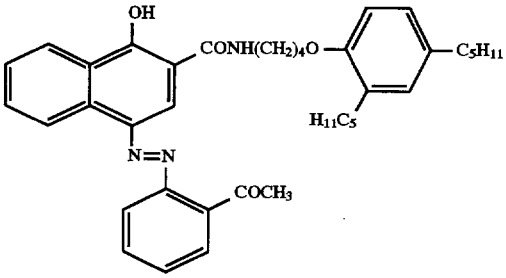

-continued
COUP-8
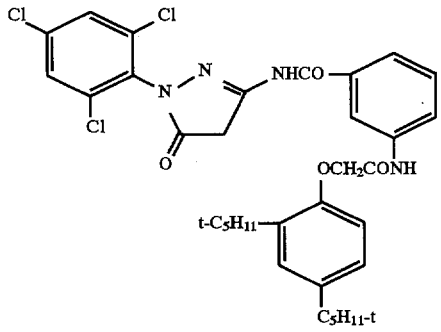
COUP-9
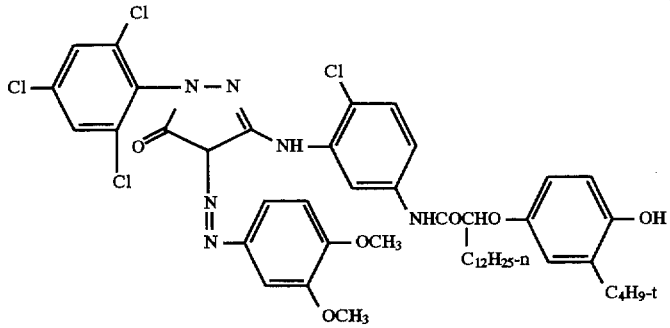
COUP-10
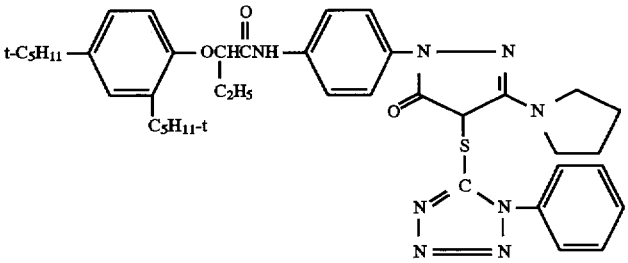
DYE-1
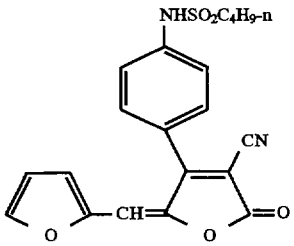
COUP-11
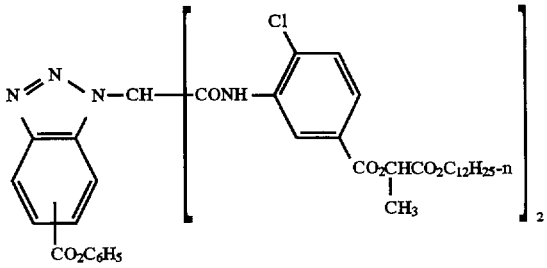

-continued

COUP-12

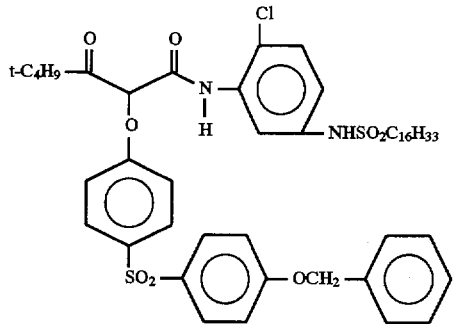

COUP-13

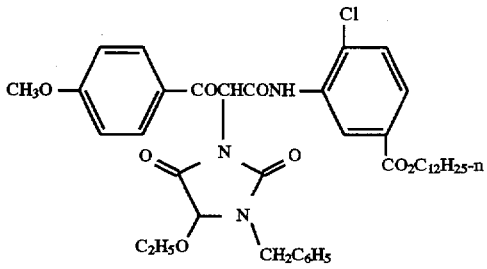

COUP-14

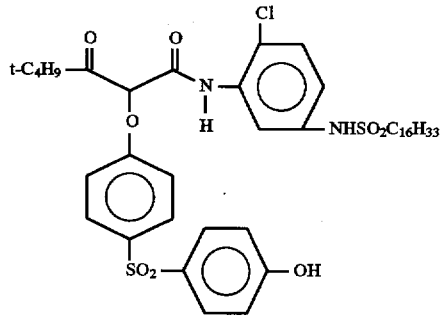

The above film and other commercially available films (labelled with a "C" number) were first exposed according to the speed rating provided on the can by the manufacturer. There are manuals well known in the art for giving the exposure conditions (shutter speed, aperture, and the like) for any given speed rating. The films were then processed in Kodak ECN-2 (a standard process for developing motion picture film) developer under standard conditions with the following specific steps:

| Step | Time |
|---|---|
| Pre-bath | 10 sec |
| Remjet Removal | 20 sec |
| Developer | 3 min |
| Stop Bath | 30 sec |
| Wash | 30 sec |
| UL Bleach | 3 min |
| Wash | 1 min |
| Fix | 2 min |
| Wash | 2 min |
| Final Rinse | 10 sec |

The formulations for the various ECN-2 processing solutions are as follows:

Pre-Bath:

20.0 g Borax (Decahydrated),
100 g Sodium Sulfate (Anhydrous),
1.0 g Sodium Hydroxide,
Water to make 1 L Developer:

2.0 mL KODdAK Anti-Calcium No. 4 (Amino-tris(methylphosphoric acid) pentasodium salt),
2.0 g Sodium Sulfite (Anhydrous),
0.22 g EASTMAN Anti-fog No. 9 (3,5-Dinitrobenzoic acid),
1.20 g Sodium Bromide (Anhydrous),
25.6 g Sodium Carbonate (Anhydrous),
2.7 g Sodium Bicarbonate,
4.0 g KODAK Color Developing Agent CD-3 (4-Amino-N-ethyl-N-(β-methanesulfonamidoethyl)-m-toluidine sesquisulfate monohydrate),
Water to make 1 L Stop Bath:

50 mL Sulfuric acid (7.0 N),
Water to make 1 L

UL Bleach:

0.07 mL Proxel GXL (1,2-Benzisothiazolin-3-one),
24.2 g KODAK Chelating Agent No. 1 (1,3-Propylene diaminetetraacetic acid),
30 mL Ammonium Hydroxide Solution (28%),
32.5 g Ammonium Bromide,
10.0 mL Acetic Acid (glacial), -continued 28.8 g Ferric Nitrate (Nonahydrate),
Water to make 1 L
Fixer:

2.0 mL KODAK Anti-Calcium No. 4 (Amino-tris(methylphosphoric acid) pentasodium salt),
185 mL Ammonium Thiosulfate Solution (58%),
10.0 g Sodium Sulfate (Anhydrous),
8.4 g Sodium Metabisulfite (Anhydrous),
Water to make 1 L
Final Rinse:

0.14 mL KODAK Stabilizer Additive (Polyoxyethylene 12 tridecyl alcohol),
Water to make 1 L The films were then read for Status M densitometry. The following Table 1 shows the results of the parameters obtained for the above invention and commercially available films:

TABLE 1

| | Slope of "AE" line .6 | | | delta log E (calculated from "CDE" line) 1.5 | | | delta log E (between point A and gray card) 1.2 | | |
|---|---|---|---|---|---|---|---|---|---|
| | Red | Green | Blue | Red | Green | Blue | Red | Green | Blue |
| C1 | 0.51 | 0.60 | 0.60 | 1.5 | 1.6 | 1.3 | 1.20 | 1.19 | 1.21 |
| C2 | 0.47 | 0.55 | 0.54 | 1.5 | 1.5 | 1.1 | 1.20 | 1.07 | 1.23 |
| C3 | 0.56 | 0.59 | 0.58 | 1.1 | 1.3 | 1.5 | 1.23 | 1.21 | 1.31 |
| C4 | 0.55 | 0.53 | 0.62 | 1.1 | 1.5 | 1.1 | 1.22 | 1.06 | 1.22 |
| C5 | 0.47 | 0.49 | 0.52 | 1.4 | 1.5 | 1.3 | 1.10 | 1.06 | 1.20 |
| C6 | 0.46 | 0.45 | 0.54 | 1.6 | 1.4 | 1.5 | 1.08 | 1.05 | 0.94 |
| C7 | 0.52 | 0.54 | 0.60 | * | 1.5 | 1.5 | 1.04 | 0.91 | 1.03 |
| C8 | 0.50 | 0.54 | 0.56 | 1.3 | 1.4 | 1.5 | 1.03 | 1.13 | 1.18 |
| C9 | 0.51 | 0.49 | 0.58 | 1.0 | 1.3 | 1.5 | 0.96 | 1.03 | 1.20 |
| C10 | 0.47 | 0.49 | 0.54 | 1.1 | 1.4 | 1.1 | 0.89 | 0.97 | 0.97 |
| Invention | 0.44 | 0.45 | 0.49 | 1.8 | 2.0 | 1.8 | 1.47 | 1.45 | 1.55 |

*Latitude too long to be accurately measured, delta log E > 2.0

In the current art, if photographers and cinematographers desire lower gamma, they would under-develop or flash any of negative films listed in the table. If they desire longer subject luminance, they would over-expose any of the negative films listed in the table. If they desire both lower gamma and longer subject luminance range, they will either under-develop and over-expose, or they will flash the negative and over-expose. When they over-expose in either case, they risk exceeding the ability of the negative material to record the highlights in the original scene. Both these cases require exposure conditions and/or development conditions that are outside manufacturer's specifications, thus requiring burdensome, tedious, and empirical procedures to determine the conditions, as described earlier. This invention solves these problems by providing a color photosensitive material that simultaneously has lower gamma, maintains blacks, and extends the subject luminance range in the highlight regions without the need for extraordinary exposure and development conditions.

Selected films listed were printed onto Eastman Color print film, 5386 and processed. The prints were made by printing the 18% gray card from each of the negative films to Status A densities 1.09 for the red, 1.06 for the green, and 1.03 for the blue. This procedure makes the 18% gray card for each print from each negative match, as described earlier in this application. This procedure is that which would be done in the art when creating prints. The results are summarized below:

| | Dmax Red | Dmax Green | Dmax Blue |
|---|---|---|---|
| C1 | 3.28 | 3.36 | 3.18 |
| C5 | 3.13 | 3.06 | 2.96 |
| Invention | 3.36 | 3.36 | 3.33 |

The present invention maintains blacks better than the other films, but still has lower contrast and extended subject luminance range in the highlight region as shown on the previous table.

While the invention has been described in detail with particular reference to preferred embodiments, it will be understood that variations and modifications can be effected within the spirit and scope of the invention.

We claim:

1. In a packaged, unexposed silver halide color negative photographic film comprising red, green and blue color sensitive records, having Film Speed and standard commercial ECN-2 processing conditions indicated with the film or its packaging, the improvement wherein on the characteristic curve of status M density versus log E for each color sensitive record which results from normal exposure of the film through a step wedge, wherein an exposure of 9.2/(Film Speed) lux-seconds is generated for an 18% gray card, and processing with the sequential standard ECN-2 processing steps of Pre-bath (10 sec), Remjet Removal (20 sec), Developer (3 min), Stop Bath (30 sec), Wash (30 sec), UL Bleach (3 min), Wash (1 min), Fix (2 min), Wash (2 min), and Final Rinse (10 sec): (1) a straight line, which connects the point at density Dmin+0.1 and the point at 1.5log E above the exposure required for density Dmin+0.2, has a mathematical slope ≦0.60; and (2) the difference in log E is ≧1.5 between the point 0.9log E above the exposure required for density Dmin+0.2 and the point where the density difference is 0.1 between the curve and the straight line which results from a linear regression of the three density points at exposures 0.3log E, 0.9log E, and 1.5log E above the exposure required for the density Dmin+0.2; and (3) the difference in log E is ≧1.20 between the exposure needed for density Dmin+0.1 and the point that corresponds to the exposure, in lux-seconds, of 9.2/(Film Speed).

2. An unexposed color negative photographic film according to claim 1 wherein the straight line, which connects the point at density Dmin+0.1 and the point at 1.5log E above the exposure required for density Dmin+0.2, has a mathematical slope ≦0.55.

3. An unexposed color negative photographic film according to claim 2 wherein the difference in log E is ≧1.6 between the point 0.9log E above the exposure required for density Dmin+0.2 and the point where the density difference is 0.1 between the curve and the straight line which results from a linear regression of the three density points at exposures 0.3log E, 0.9log E, and 1.5log E above the exposure required for the density Dmin+0.2.

4. An unexposed color negative photographic film according to claim 3 wherein the straight line, which connects the point at density Dmin+0.1 and the point at 1.5log E above the exposure required for density Dmin+0.2, has a mathematical slope ≦0.50.

5. In a packaged, unexposed silver halide motion picture color negative photographic film comprising red, green and blue color sensitive records, having Film Speed and standard commercial ECN-2 processing conditions indicated with the film or its packaging, the improvement wherein on the characteristic curve of status M density versus log E for each color sensitive record which results from normal exposure of the film through a step wedge, wherein an exposure of 9.2/(Film Speed) lux-seconds is generated for an 18% gray card, and processing with the sequential standard ECN-2 processing steps of Pre-bath (10 sec), Remjet Removal (20 sec), Developer (3 min), Stop Bath (30 sec), Wash (30 sec), UL Bleach (3 min), Wash (1 min), Fix (2 min), Wash (2 min), and Final Rinse (10 sec): (1) a straight line, which connects the point at density Dmin+0.1 and the point at 1.5log E above the exposure required for density Dmin+0.2, has a mathematical slope ≦0.50; and (2) the difference in log E is ≧1.7 between the point 0.9log E above the exposure required for density Dmin+0.2 and the point where the density difference is 0.1 between the curve and the straight line which results from a linear regression of the three density points at exposures 0.3log E, 0.9log E, and 1.5log E above the exposure required for the density Dmin+0.2; and (3) the difference in log E is ≧1.20 between the exposure needed for density Dmin+0.1 and the point that corresponds to the exposure, in lux-seconds, of 9.2/(Film Speed).

6. An unexposed motion picture film according to claim 5 wherein on the curve of density versus log E for each color sensitive record, the straight line which connects the point at density Dmin+0.1 and the point at 1.5log E above the exposure required for density Dmin+0.2, has a mathematical slope ≦0.45.

7. An unexposed motion picture film according to claim 5 wherein the difference in log E is ≧1.30 between the exposure needed for density Dmin+0.1 and the point that corresponds to the exposure, in lux-seconds, of 9.2/(Film Speed).

8. An unexposed motion picture film according to claim 5 wherein the difference in log E is ≧1.40between the exposure needed for density Dmin+0.1 and the point that corresponds to the exposure, in lux-seconds, of 9.2/(Film Speed).

9. A method of exposing the film of claim 1 comprising imagewise exposing the film with a normal exposure according to the Film Speed value indicated with the film or its packaging, wherein an exposure of 9.2/(Film Speed) lux-seconds is generated for an 18% gray card.

10. A method according to claim 9 additionally comprising, following imagewise exposure, processing the film without under development according to standard ECN-2 commercial processing conditions.

11. A method according to claim 10, wherein the film is not uniformly exposed prior to processing.

12. A method of exposing and processing the film of claim 5 comprising imagewise exposing the film with a normal exposure according to the Film Speed value indicated with the film or its packaging, wherein an exposure of 9.2/(Film Speed) lux-seconds is generated for an 18% gray card, then processing the film without under development according to standard ECN-2 commercial processing conditions without uniformly exposing the film prior to processing.

* * * * *